US005199554A

United States Patent [19]

Kano et al.

[11] Patent Number: 5,199,554

[45] Date of Patent: Apr. 6, 1993

[54] SPRING CONTACT

[75] Inventors: Toshiji Kano; Kenji Katayose, both of Tokyo, Japan

[73] Assignee: Hirose Electric Co., Ltd., Tokyo, Japan

[21] Appl. No.: 745,711

[22] Filed: Aug. 16, 1991

[30] Foreign Application Priority Data

Sep. 13, 1990 [JP] Japan ..... 2-95565[U]

[51] Int. Cl.[5] ..... H01H 1/26

[52] U.S. Cl. ..... 200/283; 200/275; 200/293; 200/245; 267/158

[58] Field of Search ..... 200/275, 283, 284, 293, 200/245, 530, 531, 532, 277, 277.1, 278, 280, 282, 295; 267/158, 159, 163, 164, 165

[56] References Cited

U.S. PATENT DOCUMENTS

| | | | |
|---|---|---|---|
| 2,612,577 | 9/1952 | Jacobi | 200/284 X |
| 2,710,212 | 6/1955 | Larimore | 267/163 |
| 2,714,637 | 8/1955 | Schmocker | 200/283 X |
| 3,359,395 | 12/1967 | Bruce | 200/275 X |
| 3,437,772 | 4/1969 | Piber | 200/284 |
| 3,614,359 | 10/1971 | Beck et al. | 200/283 X |
| 3,652,811 | 3/1972 | Barney | 200/284 X |
| 3,665,373 | 5/1972 | Voglesonger | 200/284 X |

FOREIGN PATENT DOCUMENTS

| | | | |
|---|---|---|---|
| 1110275 | 7/1961 | Fed. Rep. of Germany | 200/284 |
| 816174 | 7/1959 | United Kingdom | 267/163 |

*Primary Examiner*—Henry J. Recla
*Assistant Examiner*—Glenn T. Barrett
*Attorney, Agent, or Firm*—Kanesaka & Takeuchi

[57] ABSTRACT

A spring contact device consists of an insulative case (6) having at least one pair of slots extending upwardly from a bottom thereof and a contact spring (1) which includes a contact portion (3) made by bending upwardly a thick portion of a profile spring sheet such that the contact portion projects through a top of the case; a terminal portion (4) made from a thinner portion of the profile spring sheet so as to project downwardly from a bottom of the case; a U-shaped leaf spring portion between the contact and terminal portions; and at least one pair of lugs (5) extending upwardly from a lower section (2) of the U-shaped leaf spring portion and press fitted into the slots for securing the spring contact to the case.

4 Claims, 3 Drawing Sheets

SPRING CONTACT

BACKGROUND OF THE INVENTION

1. Field of the Invention

The present invention relates to spring contact for battery packs, etc.

2. Description of the Prior Art

FIG. 9 shows a conventional spring contact which includes a cylindrical sleeve 11; a semi-spherical contact 12 provided at the top of the cylindrical sleeve 11; a connection terminal 13 projecting through the bottom of the cylindrical sleeve 11 for soldering to a lead wire; and a conductive coil spring 14 placed between the contact 12 and the terminal 13 so that the contact 12 is movable in the direction of an arrow. However, since the contact 12 and the terminal 13 are connected via the fine coil spring 14, the contact resistance between them can be unstable.

To improve such a disadvantage, Japanese U.M. patent application Kokai No. 63-23776 has proposed a spring contact such as shown in FIG. 10. The spring contact includes a leaf spring 23 having a contact 21 at one end and a terminal 22 at the other. The spring contact is mounted in a case (not shown) such that the contact 21 projects through the top of the case and the terminal 22 projects through the bottom of the case. This spring contact is made by eyeletting or welding the contact 21 to the leaf spring 23, making the manufacture complicated. In addition, the connections between these two components can be different, bringing about a dispersion in the contact resistance.

SUMMARY OF THE INVENTION

Accordingly, it is an object of the invention to provide a spring contact in which the contact portion and the spring portion are integrated, thereby reducing the number of process steps and increasing the product reliability.

According to the invention there is provided a spring contact device which consists of an insulative case having at least one pair of slots extending upwardly from a bottom thereof and a spring contact mounted in the insulative case. The spring contact includes a contact portion made by bending upwardly a thick portion of a profile spring sheet such that the contact portion projects through a top of the case; a terminal portion made from a thinner portion of the profile spring sheet so as to project downwardly from a bottom of the case; a U-shaped leaf spring portion between the contact and terminal portions; and at least one pair of securing means extending upwardly from a lower section of the U-shaped leaf spring portion and press fitted into the slots for securing the spring contact to the case.

The above and other objects, features, and advantages of the invention will be more apparent from the following description when taken in conjunction with the accompanying drawings.

DESCRIPTION OF THE PREFERRED EMBODIMENT

Figure 1:
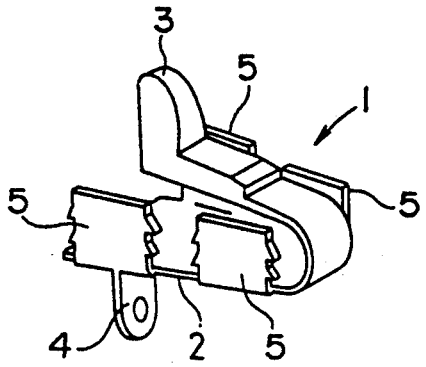
FIG. 1 is a perspective view of a spring contact according to an embodiment of the invention.
Figure 2:
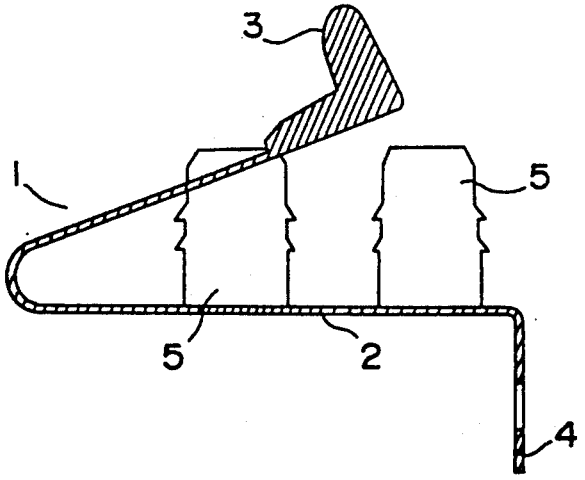
FIG. 2 is a longitudinal section of the spring contact.
Figure 3:
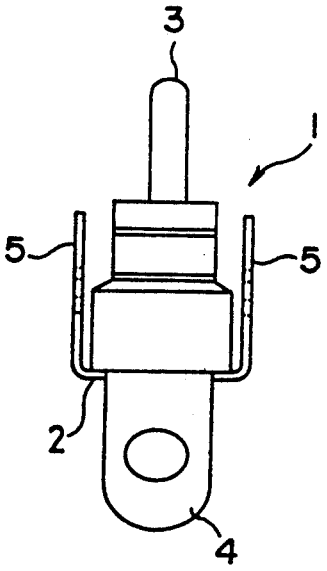
FIG. 3 is a front view of the spring contact.
Figure 4:
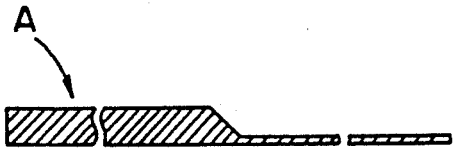
FIG. 4 is a sectional view of a leaf spring for the spring contact.

In FIGS. 1-3, a spring contact 1 is made by bending into a U-shaped section a spring plate A which is made from phosphorous bronze so as to have a profile section as shown in FIG. 4, wherein it is thick at one end; e.g., 1 mm thick, and less thick at the other end; e.g., 0.2 mm thick. The thick end portion is bent upward at substantially right angles to form a contact portion 3 which is to be brought into contact with a battery, etc. The thinner other end portion constitutes a connection terminal 4 to which a lead wire, for example, is connected. Two pairs of lugs 5 extend upwardly from the lower section 2 of the U-shaped leaf spring. These lugs 5 have engaging projections extending outwardly from opposite sides thereof and are press fitted in slots of the case to secure the spring contact 1 to the case. Such a one-piece spring contact 1 is formed by a press from the profile spring sheet A as shown in FIG. 4.

Figure 5:
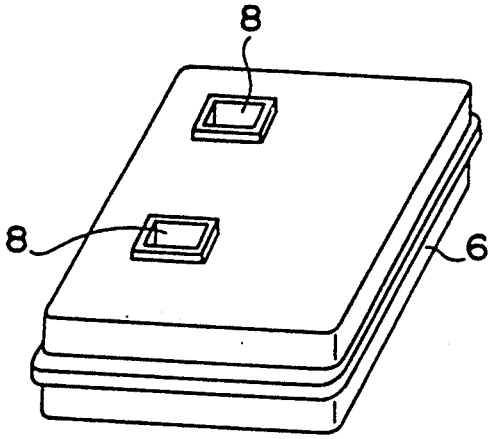
FIG. 5 is a perspective view of a case wherein the spring contact is set.
Figure 6:
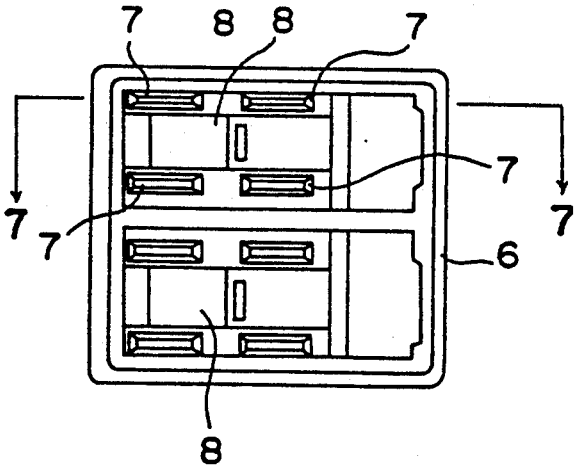
FIG. 6 is a bottom plan view of the case.
Figure 7:
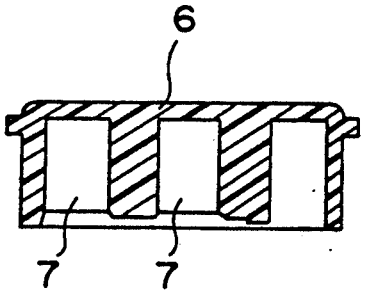
FIG. 7 is a sectional view taken along line 7—7 of FIG. 6.
Figure 8:
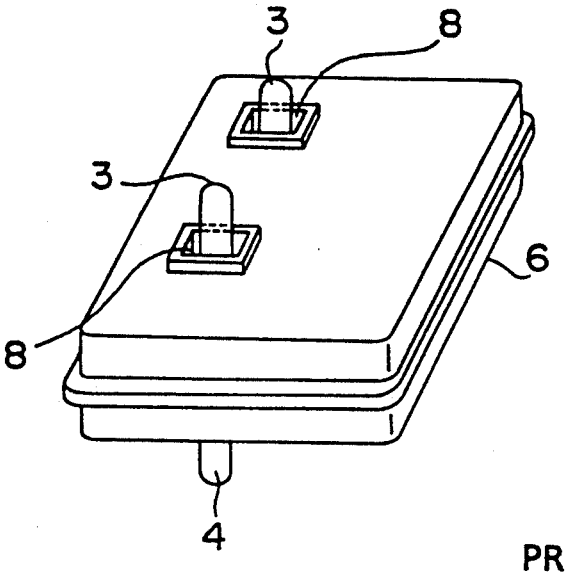
FIG. 8 is a perspective view of the case wherein a pair of spring contacts are set.
Figure 9:
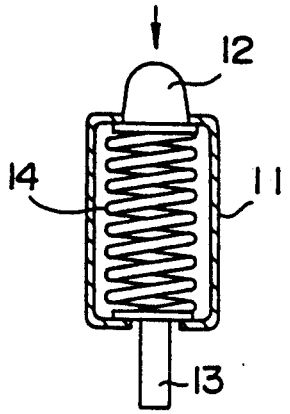
PRIOR ART FIG. 9
FIG. 9 is a section view of a conventional spring contact.
Figure 10:
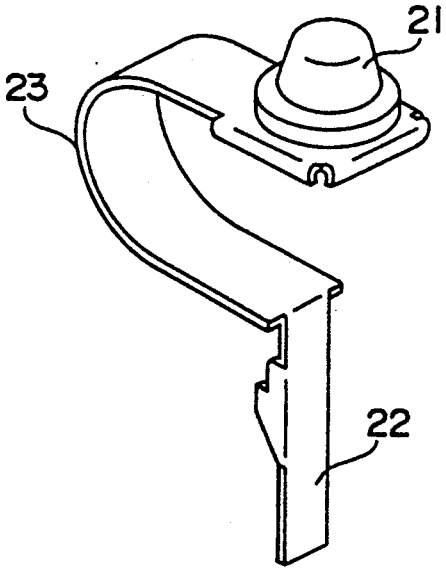
PRIOR ART FIG. 10
FIG. 10 is a perspective view of another conventional spring contact.

In FIGS. 5-7, the spring contact 1 is set in a case 6 which is made from an insulative synthetic resin. The case 6 has eight press fit slots 7 extending upwardly from the bottom. The spring contact 1 is secured to the case 6 by press fitting the lugs 5 of the spring contact 1 into these slots 7 such that the contact portion 3 projects through a contact aperture 8 on the top of the case 6 for contact with a battery (not shown). Between the contact aperture 8 and the contact portion 3 there is provided a gap sufficiently large to permit the contact portion 3 to be displaced by a force. The connection terminal 4 extends downwardly through the bottom of the case 6 and connected to a lead wire (not shown). In FIG. 8, a pair of such spring contacts 1 are set in the case 6.

The spring contact 1 includes a U-shaped leaf spring which has a resilient property for upwardly biasing the contact portion 3 so that the contact portion 3 is brought into contact with a mating surface with an appropriate force, thereby not only assuring an appropriate electrical conductivity but also producing a self-cleaning effect by friction, which makes a better contact.

As has been described above, according to the invention, the contact portion and the spring portion are made integral, thereby not only making the manufacture simpler than before but also providing reliable products having little or no dispersion in the contact resistance.

We claim:

1. A spring contact device comprising:

an insulative case having at least one pair of slots extending upwardly from a bottom thereof; and a spring contact attached to said insulative case, said spring contact comprising:

a contact portion made by bending upwardly a thick portion of a profile spring sheet at one end such that said contact portion projects through an aperture in a top of said case;

a terminal portion made from a thinner portion of said profile spring sheet at another end so as to project downwardly from a bottom of said case;

a U-shaped leaf spring portion made from a middle portion of said profile spring sheet between said contact and terminal portions, thereby connecting said contact portion to said terminal portion such that said contact portion is resiliently movable with respect to said terminal portion; and at least one pair of press-fit lugs extending upwardly from opposite sides of a lower section of said U-shaped leaf spring portion such that an upper section of said U-shaped leaf spring portion is disposed between said press-fit lugs, said press-fit lugs having engaging projections and being press fitted into said slots for securing said spring contact to said case.

2. A spring contact for a spring contact device having an insulative case which has at least one pair of slots extending upwardly from a bottom thereof, said spring contact comprising:

a contact portion made by bending upwardly a thick portion of a profile spring sheet at one end such that said contact portion projects through an aperture in a top of said case;

a terminal portion made from a thinner portion of said profile spring sheet at another end so as to project downwardly from a bottom of said case;

a U-shaped leaf spring portion made from a middle portion of said profile spring sheet between said contact and terminal portions, thereby connecting said contact portion to said terminal portion such that said contact portion is resiliently movable with respect to said terminal portion; and at least one pair of press-fit lugs extending upwardly from opposite sides of a lower section of said U-shaped leaf spring portion such that an upper section of said U-shaped leaf spring portion, said press-fit lugs having engaging projections extending outwardly from opposite sides thereof and being press fitted into said slots for securing said spring contact to said case.

3. The spring contact of claim 2, wherein said profile spring sheet increases in thickness stepwise from a rear portion to a front portion thereof wherein said terminal portion is formed at said rear portion and said contact portion is formed at said front portion.

4. The spring contact of claim 3, wherein said profile spring sheet has a thickness of about 1 mm in said front portion and a thickness of about 0.2 mm in said rear portion.

* * * * *